United States Patent [19]

Mullins

[11] 4,107,894

[45] Aug. 22, 1978

[54] INTERLOCKING CEMENTITIOUS BUILDING BLOCKS

[76] Inventor: Wayne L. Mullins, 5001 E. Cactus, Scottsdale, Ariz. 85254

[21] Appl. No.: 799,725

[22] Filed: May 23, 1977

Related U.S. Application Data

[63] Continuation-in-part of Ser. No. 736,724, Oct. 29, 1976, abandoned, which is a continuation-in-part of Ser. No. 582,378, Apr. 30, 1975, abandoned.

[51] Int. Cl.[2] ..... E04C 1/10

[52] U.S. Cl. ..... 52/593; 52/606

[58] Field of Search ..... 52/593, 596, 606, 604, 52/589, 594; 46/25, 26

[56] References Cited

FOREIGN PATENT DOCUMENTS

| | | | |
|---|---|---|---|
| 78,050 | 8/1918 | Switzerland | 52/607 |
| 263,865 | 6/1927 | United Kingdom | 52/594 |

*Primary Examiner*—Stephen J. Novosad
*Assistant Examiner*—Carl D. Friedman
*Attorney, Agent, or Firm*—Herbert E. Haynes, Jr.

[57] ABSTRACT

Cementitious building blocks having upstanding male projections on one planar surface and recessed female cavities on the opposite surface. The male projections and female cavities are disposed in special identical geometric arrays which allows interlocked mortarless assembly of a plurality of such blocks for the construction of buildings, walls and the like. The blocks are further provided with passages extending therethrough which are especially configured for weight and aesthetic considerations.

21 Claims, 10 Drawing Figures

Fig. 8
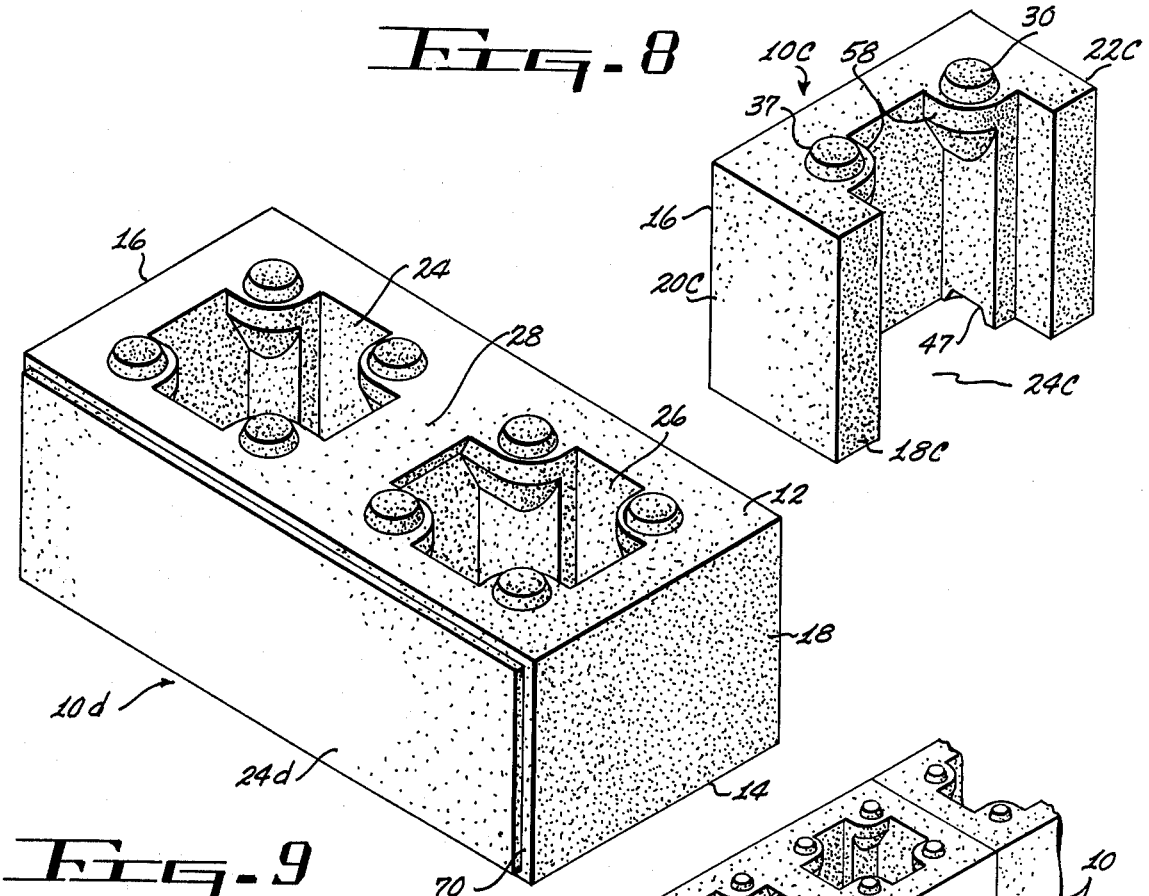
Fig. 9
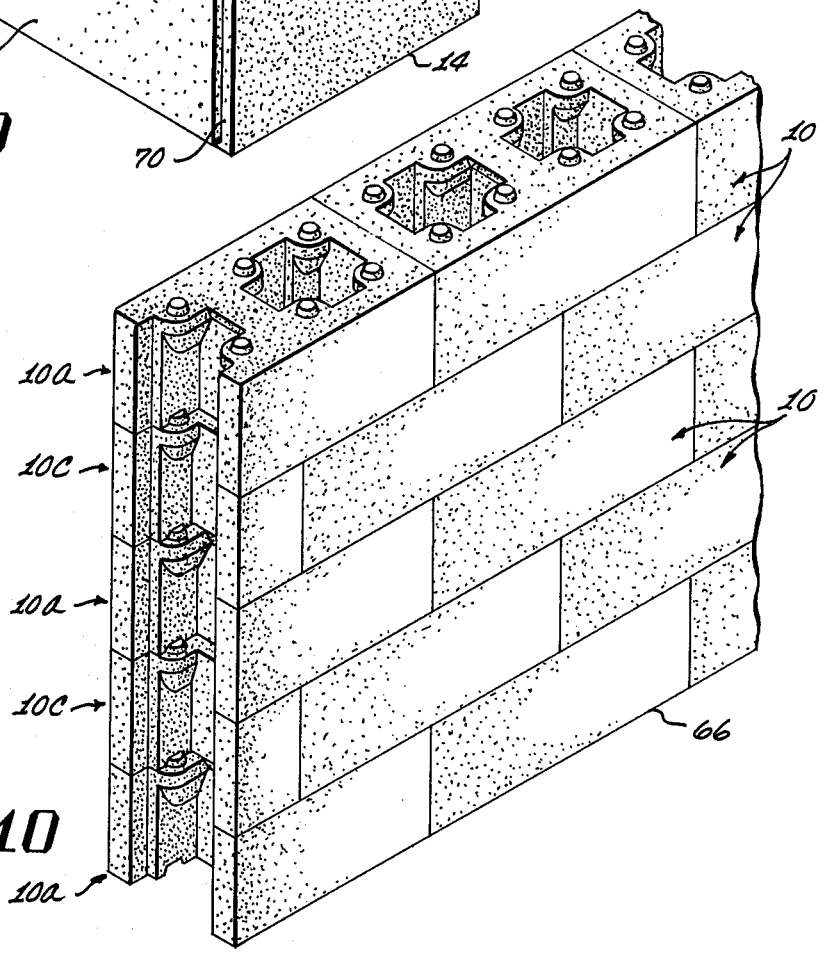
Fig. 10

INTERLOCKING CEMENTITIOUS BUILDING BLOCKS

REFERENCE TO RELATED APPLICATIONS

This application is a continuation-in-part of a copending U.S. patent application Ser. No. 736,724, filed Oct. 29, 1976, for INTERLOCKING BUILDING BLOCK, now abandoned, with that application being in turn a continuation-in-part of U.S. patent application Ser. No. 582,378, filed Apr. 30, 1975, for INTERLOCKING BUILDING BLOCK, now abandoned, all by the same inventor.

BACKGROUND OF THE INVENTION

1. Field of the Invention

This invention relates to cementitious building blocks and more particularly to mortarless interlocking cementitious building blocks.

2. Description of the Prior Art

The use of building blocks, of the type sometimes referred to as cement blocks, concrete blocks, or cinder blocks, rather than conventional clay bricks is becoming more widespread. Such building blocks are commonly used by the construction industry for erecting walls, buildings and the like, and for purposes of this description, all such blocks will hereinafter be referred to as cementitious blocks.

The commonly used cementitious blocks are erected in tiers or rows, which are most often offset, and the individual cementitious blocks are bonded together by mortar which is interposed between the meeting horizontal and vertical faces of the blocks. The necessity of mortar bonding impairs the accuracy and speed with which such blocks can be erected, and requires a relatively high degree of skill to erect a properly aligned plurality of such blocks.

The degree of skill needed to erect these mortar bonded prior art blocks, not to mention the laborious task, has all but relegated the laying of such blocks to skilled craftsmen.

The laborious task of erecting the mortar bonded blocks and the high cost of employing skilled craftsmen has prompted the search for interlocking cementitious blocks which would ease the labor and degree of skill needed to lay and properly align a plurality of such blocks.

Therefore, there are examples in the prior art of cementitious blocks having recesses in one of the horizontal surfaces and projections extending from the opposite horizontal surface. Such interlocking blocks allow the interlocked assembly of one row of such blocks with parallel coextending rows immediately above and below that row. Many of such prior art interlocking blocks are still bonded together by mortar, and it is believed that the use of such mortar impairs, to at least some degree, the interlocking and the ease of accurately aligning such blocks. Although the degree of skill required to lay such interlocking blocks has been reduced, it is still desirable to employ a skilled craftsman as the use of mortar is still required, and the accuracy of block alignment still must be considered.

Still further, other prior art interlocking blocks are known which are mortarless, and all of those blocks have shortcomings of one sort or another. For example, some of those blocks are very heavy which, of course, creates problems for the block layer. Others are loose fitting so that the problems of alignment are not alleviated. One particular interlocking block relies on an interference fit between interlocking elements of the block to compensate for dimensional inaccuracies, and this creates assembly problems in that manually applied forces must be exerted to achieve an interference fit which sometimes involves scraping off excess materials. In many instances, building codes require that all cells or cavities within a wall of such prior art blocks be grouted solid with a cementitious material.

While the known art includes an example of a building block having eight recesses entering into the body thereof on one horizontal surface and eight projections extending from the opposite horizontal surface, those recesses and projections are so arranged that it is impossible to interlock one block with another similar block in a normal relationship. This is due to the fact that this known block does not have a relationship between its longitudinal and transverse dimensions which is critical and also because the four recesses and projections at each end of the block define an oblong rather than a square. Thus, it is impossible to interlock the four projections at one end of one block with the four recesses of another block arranged normally thereto.

It is a long standing custom to form most, if not all, cementitious building blocks with passages formed therein which extend between the horizontal faces. These passages are provided for several reasons. First, they accommodate any wiring, pipelines, and the like which are to be included in a building wall, and secondly, they materially lighten the weight of the block to facilitate shipping and handling by craftsmen and reduce the material, and thus the cost, of making the blocks. And, finally, the passages not used to accommodate wiring and pipelines, may be filled with suitable grouting material when it is desired to strengthen an erected structure. The cementitious blocks of this type normally have two passages formed therethrough which are of maximum cross section for weight considerations and to accommodate the wiring and/or pipelines, and must not be excessively large so as to lessen the load bearing capabilities of the block.

Many of the prior art interlocking blocks, as discussed above, have substantially reduced the cross sectional areas of the vertical passages formed therein due to the necessity of supporting the interlocking elements of the blocks. This, of course, increases the weight of such blocks, and reduces clearance for wiring and pipelines.

Therefore, a need exists for a new and improved mortarless interlocking cementitious building block which overcomes some of the problems and shortcomings of the prior art.

SUMMARY OF THE INVENTION

In accordance with the present invention, new and improved cementitious building blocks are disclosed for mortarless interlocked assembly with similar blocks for erecting walls, buildings, and other similar structures. The most commonly employed form of cementitious block is configured to form a dimensionally precise rectangular solid having, among other things, an upper planar surface and a parallel equally sized lower planar surface, both of which are normally disposed in a horizontal attitude when employed for construction, and both of which are normally twice as long as they are wide.

Eight recesses are formed in the lower planar surface of the block and eight projections are provided to extend from the upper surface thereof. The recesses and projections are disposed in identical especially arranged geometric arrays which allow the blocks to snugly interlock with other similar blocks disposed above and below. These special arrays also allows the blocks to be interlockingly assembled in laterally offset relationships and in cross, or normal relationships.

Two vertical passages are formed through the cementitious block and are disposed to extend between the upper and lower surfaces. The passages are designed to provide maximum horizontal cross sectional areas to admit wiring, pipes and the like, and for weight considerations, without impairing the load bearing capabilities of the blocks. The passages are configured in a cross-like configuration to provide vertically extending columns which extend between the upper and lower horizontal surfaces with those columns providing cementitious material in which the recesses are formed and from which the projections extend.

In addition to the above described most commonly employed cementitious building block which may be described as a "full" block, one-half, three-quarter, and one-quarter blocks are provided for use in framing wall openings, terminating walls, constructing columns and the like. The three-quarter and one-quarter blocks are open on one end thereof, i.e., the passages described above in regard to the full block, are closed on three vertical sides and open on the other. Such openings may, if desired, be exposed on the terminal end of the wall, or in a block column, to provide an aesthetic appearance which is provided by the internal configuration of the passages.

Accordingly, it is an object of the present invention to provide a new and improved cementitious building block.

Another object of the present invention is to provide new and improved dimensionally precise cementitious building blocks for mortarless interlocked assembly.

Another object of the present invention is to provide new and improved cementitious building blocks which are especially configured to have a plurality of male projections extending from one planar surface and a plurality of female recesses formed in the opposite planar surface with those projections and recesses disposed in identical geometric arrays to allow mortarless snug interlocked assembly of the blocks in stacked vertical alignment with each other, or in stacked laterally offset alignment with each other, for the erection of stacked coextending rows and/or stacked transverse or normal rows.

Another object of the present invention is to provide new and improved interlocking mortarless cementitious blocks of the above described character in which the interlocking elements in the form of projections and recesses are of special design so as to hold the weight added thereby to a minimum, and to provide a snug fit between the interlocked blocks.

Another object of the present invention is to provide new and improved cementitious building blocks of the above described character each of which are provided with a pair of vertical passages extending therethrough which are especially configured to provide the blocks with minimum weight, maximum clearance for wiring and pipelines, and yet provide sufficient load bearing strength for the blocks.

Another object of the present invention is to provide new and improved mortarless interlocking cementitious building blocks of the above described character in which the vertical passages of each block have cross-like horizontal cross sectional configurations to provide vertically extending columns of cementitious material for supporting the interlocking elements of the blocks.

Still another object of the present invention is to provide mortarless interlocking cementitious building blocks of the above described character which may be formed in full, one-half, three-quarter and one-quarter blocks.

Yet another object of the present invention is to provide mortarless interlocking cementitious building blocks with the three-quarter and one-quarter blocks displaying an aesthetically appealing open end.

The foregoing and other objects of the present invention, as well as the invention itself, may be more fully understood from the following description when read in conjunction with the accompanying drawings.

BRIEF DESCRIPTION OF THE DRAWINGS

FIG. 8 is an isometric view of the one-quarter mortarless interlocking cementitious building block of the present invention.

FIG. 9 is an isometric view similar to FIG. 1 but illustrating a modified embodiment of the building block of the present invention.

FIG. 10 is a fragmentary isometric view illustrating the aesthetically appealing terminal end of a wall formed by the interlocking mortarless cementitious building blocks of the present invention.

DESCRIPTION OF THE PREFERRED EMBODIMENT

Figure 1:
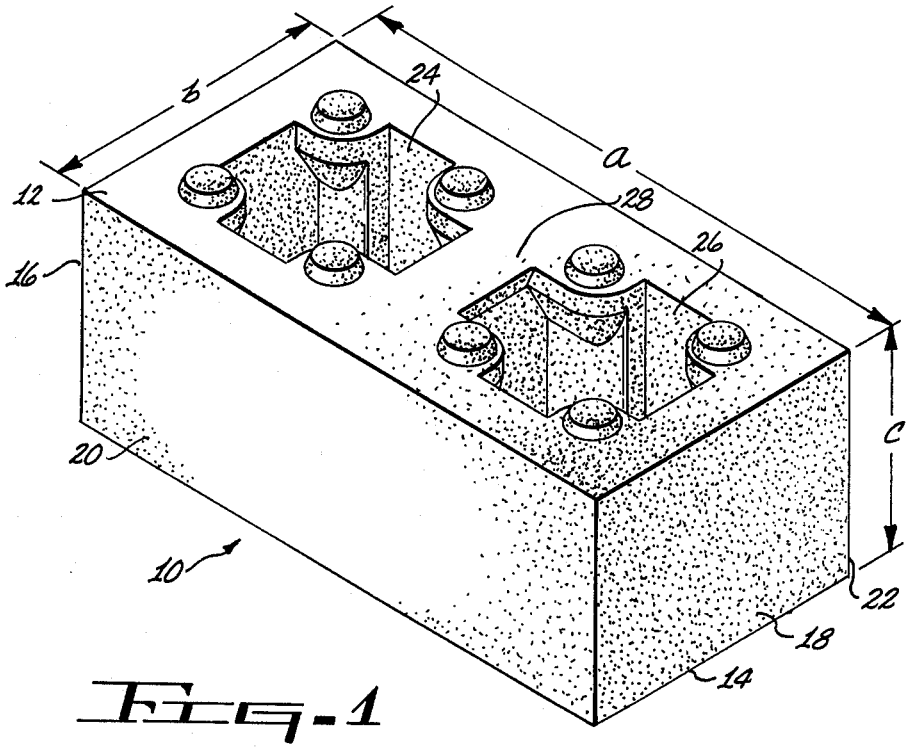
FIG. 1 is an isometric view of the cementitious interlocking mortarless building block of the present invention illustrating the various features thereof.

Referring more particularly to the drawings, FIG. 1 illustrates the most commonly employed mortarless interlocking cementitious building block of the present invention which is indicated generally by the reference numeral 10. At this point, it is well to note that the block 10 is fabricated of cementitious material preferably formulated in a manner to provide relatively smooth surfaces so that a plurality of such blocks 10 may be interlockingly assembled with the mating surfaces in exact aligned engagement without mortar being interposed therebetween.

The block 10 is formed to provide a rectangular solid configuration having proportions which are conventional in the industry. That is, the longitudinal dimension "*a*" being twice the width dimension "*b*". The relationship between dimension "*a*" and "*b*" is critical, however, the height dimension "*c*" may vary. For example, a particular cementitious block having a longitudinal dimension of 16 inches with a width dimension of eight (8) inches, may have a height dimension of four (4), six (6), or eight (8) inches.

As will become apparent as this description progresses, the blocks of the present invention must be formed with dimensional precision in order to achieve snug interlocking fits between a plurality of the blocks and thereby produce properly level and aligned walls. To illustrate this point, consider that in prior art mortar bonded blocks, the mortar itself is employed to compensate for dimensional irregularities and inaccuracies which can, and often do, occur in the peripheral dimensions, surface parallelism and the like.

Therefore, the cementitious blocks of the present invention are fabricated with precision peripheral dimensions, in addition to the interlocking elements thereof, so that the blocks will snugly interlock to form properly level and aligned walls.

For example, one of the blocks 10 described above as having the desired dimensions of: height six (6) inches, length 16 inches and width eight (8) inches, is fabricated with its height dimension being six (6) inches ± 0.015, its length dimension being in the range of from 15.910 to 15.994 inches and its width dimension being eight (8) inches ± 0.031. As seen, the width dimension is not as critical as the height and length dimensions in that the width dimension controls surface regularity and wall thickness which can be allowed to vary somewhat, whereas the length and height dimensions control surface parallelism and the interlocking fit, both of which must be held within specific tolerances. The height and width dimensions are also critical in that an adhesive gap must be provided between meeting surfaces of adjacent blocks as will hereinafter be described.

Therefore, the criticality of the dimensional precision of the cementitious building blocks of the present invention may be described as a height dimension of: the desired height in inches ± 0.015 inches, and a length dimension of the desired length in inches less an amount in the range of from 0.006 to 0.090 inches.

The block 10 is provided with an upper horizontally disposed surface 12, a parallel lower surface 14, vertically disposed end surfaces 16 and 18, and opposed vertical face surfaces 20 and 22. As will hereinafter be described in detail, the block 10 is provided with an identical pair of especially configured passages 24 and 26 separated by a partition 28, and which extend vertically through the block 10.

Figure 2:
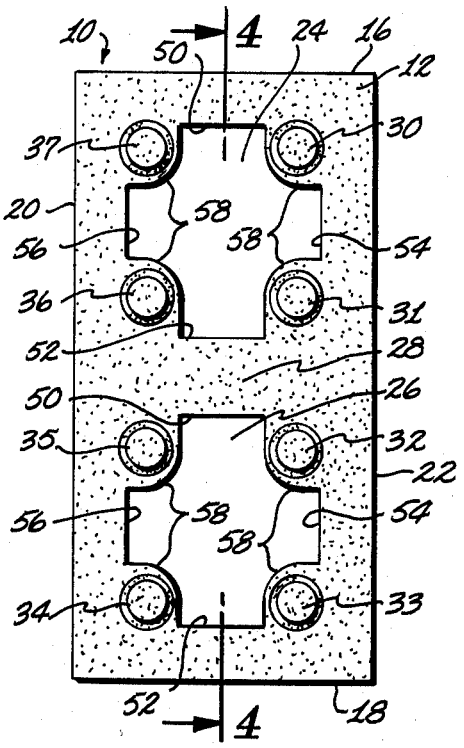
FIG. 2 is a top plan view of the cementitious building block of the present invention.

As seen best in FIG. 2, eight male projections are integrally formed on the upper horizontal surface 12, with those projections being designated by the numerals 30, 31, 32, 33, 34, 35, 36 and 37. Those projections 30–37 are of frustro-conical configuration and extend normally from the surface 12. The projections 30–33 are disposed in a row which extends longitudinally of the block 10, and are equally spaced with respect to each other. The projection 30 is spaced from the end 16 of the block 10 exactly the same distance as the projection 33 is spaced from its adjacent end surface 18 of the block 10. The projections 34–37 are equally spaced with respect to each other in another row which extends longitudinally of the block 10, with the space between the row of projections 30–33 and the row of projections 34–37 being exactly the same as the space between any two projections in the rows. Moreover, the row of projections 30–33 are spaced from the vertical face 22 exactly the same distance as the row of projections 34–37 are spaced from the vertical face 20.

To avoid ambiguity and give definite meaning to the language describing the critical specific geometric arrangement of the projections 30–37, it will be seen that projections 30, 31, 36 and 37 are located at one end of the block 10, form a perfect square, and will hereinafter be identified as end projections. Likewise, the projections 32, 33, 34 and 35 are located at the opposite end of the block 10, form a perfect square, and will hereinafter be described as end projections. In addition to forming part of the end projections, the projections 31, 32, 35 and 36 form a perfect square and will be identified as intermediate projections. The square formed by end projections 30, 31, 36 and 37 is identically sized with respect to the square formed by end projections 32, 33, 34 and 35, and with respect to the square formed by intermediate projections 31, 32, 35 and 36.

Figure 3:
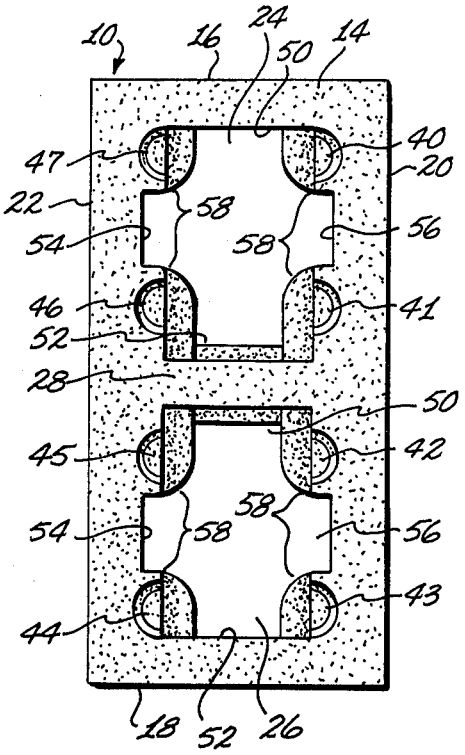
FIG. 3 is a bottom plan view of the cementitious building block of the present invention.

As best seen in FIG. 3, eight (8) female recesses, or cavities, are formed in the lower horizontal surface 14, with those recesses being identified by the reference numerals 40, 41, 42, 43, 44, 45, 46 and 47. As will hereinafter be described in detail, each of the recesses 40–47 are configured to form one-half of a frusto-conical cavity, and each of them is complemental to projections 30–37. The recesses 40–47 are disposed in the lower surface 14 in exactly the same geometric arrangement as the projections 30–37 are disposed on the upper surface 12.

Due to the above described identical geometric dispositions of the projections 30–37 and recesses 40–47, it will be seen that a plurality of the blocks 10 can be assembled in any of the ways that conventional cementitious blocks are laid in formation of straight walls, corners, intersecting walls and the like.

As hereinbefore mentioned, the block 10 is provided with a pair of especially configured vertically extending passages 24 and 26 which are separated by a partition 28. The passage 24 is located between end projections 30, 31, 36 and 37, and between end recesses 40, 41, 46 and 47, and the passage 26 is located between end projections 32, 33, 34 and 35, and between end recesses 42, 43, 44 and 45.

The passages 24 and 26 are of a specific cross sectional configuration, with that specific shape being critical. The criticality of that shape provides the block 10 of the present invention with characteristics and features that are mandatory and/or desirable in a block of the instant type. In the first place, the passages 24 and 26 must be of maximum cross sectional area to reduce the weight of the block as much as possible to facilitate shipping and handling thereof, and to effect a savings of cementitious material. However, the passages 24 and 26 must not be excessively large or else wall thicknesses would be reduced to a point that could effect the load bearing capabilities of the block. Further, the passages 24 and 26 must be sufficiently large to accommodate wiring and pipelines which may be located within walls constructed of a plurality of the blocks 10. For example, the passages 24 and 26 must be large enough to accept sewer pipes having a four (4) inch outside diameter.

In addition to the above, the passages 24 and 26 are each formed in the specific cross-like horizontal cross sectional configuration as shown so as to provide each of the passages with a pair of opposed longitudinally extending open portions 50 and 52 and a pair of opposed transversely extending open portions 54 and 56. In this manner, a vertically disposed columnar formation 58 of cementitious material is provided between each adjacent pair of longitudinal and transverse open portions.

In other words, one vertically extending columnar formation 58 is located between longitudinal open portion 50 and transverse open portion 54, another columnar formation 58 is located between transverse open portion 54 and longitudinal open portion 52, etc.

Therefore, the block 10 of the present invention is provided with eight (8) of the vertically extending cementitious columnar formations 58 which are located so as to support the upstanding projections 30–37, and in which the recesses 40–47 are formed.

As seen best in FIGS. 4 and 5, the columnar formations 58 themselves are of special design which materially reduces the weight of the block 10 and produces an aesthetic effect in some instances as will hereinafter be described in detail.

The cementitious columnar formations 58 are each formed with a shelf-like upper portion 60 adjacent the upper planar surface 12 of the block 10 for supporting their respective ones of the frusto-conical projections 30–37. Immediately below each of the shelves 60, a transition portion 62 angularly depends and merges with a reduced mass portion 64 which extends to the lower planar surface 14 of the block 10. As seen best in FIG. 5, the thickness of the reduced mass portions 64 are approximately one-half of the thickness dimension of the shelves 60, therefore, the recesses 40–47 which are formed in the reduced mass portions 64, are each approximately one-half of a downwardly and laterally inwardly opening frustro-conical recess or cavity.

Figure 4:
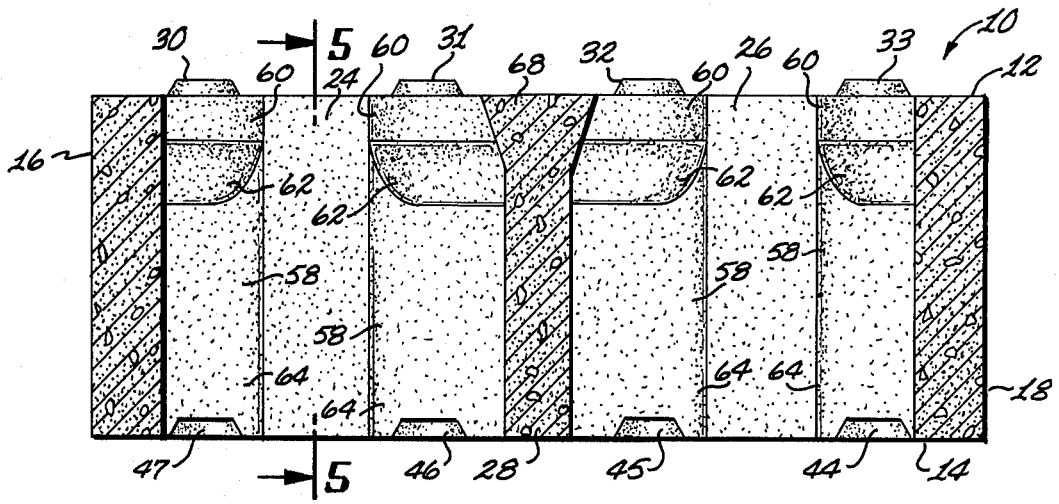
FIG. 4 is an enlarged sectional view taken on the line 4—4 of FIG. 2.
Figure 5:
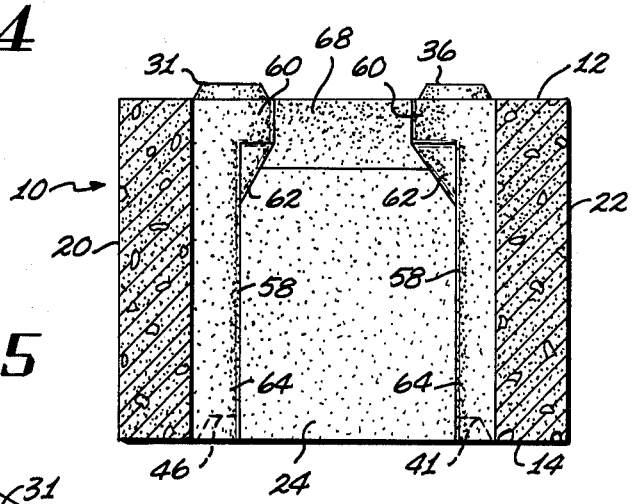
FIG. 5 is a sectional view taken on the line 5—5 of FIG. 4.

As best seen in FIG. 4, the partition which separates the passages 24 and 26 is preferably formed with an upwardly and outwardly flared in cross section portion 68 at its upper end. The outwardly flared upper portion 68 is provided for two reasons; first, to facilitate lifting of the block 10 by a person assembling a plurality thereof, and for aesthetic reasons as will hereinafter be described.

As hereinbefore mentioned, one-quarater, one-half, and three-quarter blocks may be formed in accordance with the concepts of the present invention to facilitate the framing of wall openings, terminating walls, construction of block pillars and the like, and for aesthetic reasons.

Figure 6:
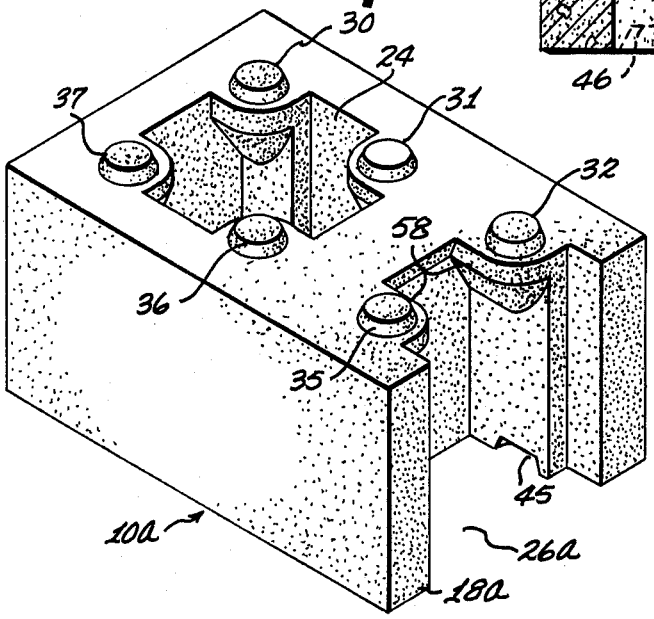
FIG. 6 is an isometric view of the three-quarter cementitious interlocking mortarless building block of the present invention.

Referring to FIG. 6 wherein a three-quarter cementitious block **10*a* is shown to be similar to the previously described full block 10, except that the three-quarter block 10*a* is formed to be three-fourths the length of the full block 10 with all other dimensions and proportions being identical. This results in the passage 26*a* being one-half of the previously described passage 26, i.e., the passage 26*a* is open on one laterally disposed end thereof which forms an interrupted end surface 18*a*. Therefore, the block 10*a* is open on one end which exposes the internal configuration of the passage 26*a*. It will be noted that the projections 32 and 35 are now end projections and are spaced from interrupted end surface 18*a* the same distance as projections 30 and 37 are spaced from end surface 16**.

Figure 7:
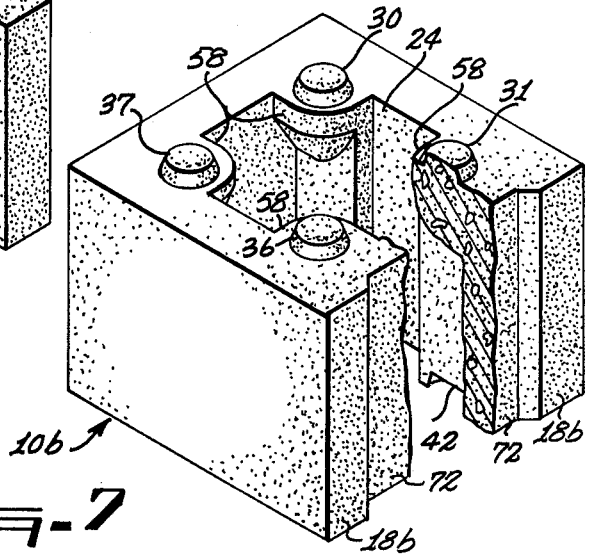
FIG. 7 is an isometric view of a half block of the present invention which is partically broken away to show the various features thereof.

FIG. 7 illustrates a half block **10*b* which is formed to be one-half of the length of the full block with all other dimensions and proportions being the same. Thus, the half block includes only the passage 24, four (4) of the cementitious columnar formations 58, four (4) of the projections 30, 31, 36 and 37, and four (4) of the recesses 40, 41, 46 and 47 with only recess 46 being shown. It will be noted that projections 30, 31, 36 and 37 are spaced equidistantly from their respectively adjacent end and side surfaces of the block 10*b*. In addition, the block 10*b* may be formed with an indentation 72 on the end 18*b*** for decorative purposes.

FIG. 8 illustrates a one-quarter block **10*c* which is formed to be one-fourth of the length of the full block 10 with all other dimensions and proportions being the same. Thus, the block 10*c* includes only those portions of the block which define one-half of the previously described passage 24. Therefore, the block 10*c* is similar to block 10*a* in that it is open on one end which exposes the internal configuration of the passage 24*c*. The projections 30 and 37 are aligned with each other normally with respect to vertical face surfaces 20*c* and 22*c* and are equally spaced between end surface 16 and interrupted end surface 18*c***.

FIG. 10 illustrates a typical way in which the blocks of the present invention are employed. As shown, a wall 66 is assembled by employing a plurality of the full blocks 10 in the customary manner in which such blocks are laid in laterally offset relationships. Termination of the wall 66 built in that manner results in an uneven end which is made into an even terminal end by alternately employing the three-quarter and one-quarter blocks **10*a* and 10*c***, respectively.

It will be noted that the blocks **10*a* and 10*c* are positioned so that their open ends are exposed which takes advantage of the aesthetic effects produced by the geometric patterns of the columnar formations 58 and the partitions 28 within those open ends. Many variations of aesthetic effects can be created in that by forming those blocks 10*a* and 10*c* without the male projections, those blocks can be alternately inverted if desired to arrive at various geometric arrangements. Further, the blocks 10*a* and 10*c*** can be disposed in a manner so that their open ends are hidden which would result in a plane closed terminal end (not shown).

From the foregoing, it will be appreciated that the cementitious blocks **10, 10*a*, 10*b* and 10*c* can be interlockingly assembled in any desired manner without employing any mortar. However, if a more permanent structure is desired, a suitable adhesive (not shown), such as epoxy, can be applied to the mating surfaces of adjacent blocks. In any event, the blocks 10, 10*a*, 10*b* and 10*c* which are interlockingly assembled will produce a relatively smooth wall face, such as shown in FIG. 10**. If desired, the cementitious blocks of the present invention can be formed to provide a simulated mortar gap (not shown), so that walls erected by employing the blocks of the present invention will display a more conventional appearance.

As shown in FIG. 9, a cementitious block **10*d* which is similar to block 10, is provided with an endless recessed channel 70 formed about the periphery of the vertical face surface 20*d*. A similar channel may be formed on the opposite vertical face (not shown) if desired. The channel 70 is preferably sized so that when the blocks 10*d*** are interlockingly assembled as previously described, the adjacent channels will simulate a conventionally sized mortar gap (not shown).

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An interlocking building block comprising:

(a) a cementitious body of rectangular solid configuration having an upper horizontal surface and a lower horizontal surface;

(b) eight (8) projections integrally formed to extend normally from the upper horizontal surface of said body, said projections arranged on the upper surface in a predetermined geometric array;

(c) eight (8) recesses formed in the lower surface of said body and configured to be complemental to said projections, said recesses arranged on the lower surface in the same geometric array as said projections are arranged on the upper surface of said body; and (d) a spaced pair of passages formed through said body so as to extend between the upper and lower horizontal surfaces thereof, said passages formed in cross-like shapes in horizontal cross section to provide said body with eight (8) vertically disposed cementitious columnar formations for supporting said projections and in which said recesses are formed, each of said vertical columnar formations comprises, I. a shelf-like portion on the upwardly disposed end for supporting one of said projections, II. a reduced mass portion on the downwardly disposed end in which one of said recesses is formed, and III. a transition portion depending angularly from said shelf-like portion and merging with said reduced mass portion.

2. An interlocking building block as claimed in claim 1 wherein;

said cementitious body is formed with a height of the desired dimension in inches ± 0.015, and a length of the desired dimension in inches less an amount in the range of from 0.006 to 0.090.

3. An interlocking building block as claimed in claim 1 wherein the predetermined geometric array of said projections comprises;

said projections arranged in two spaced apart longitudinally extending rows with each row having four (4) of said projections equidistantly spacedly arranged therein, the four (4) projections in one row being transversely aligned with the four (4) projections in the other row with the space between each adjacent pair of longitudinally aligned projections being equal to the space between said pair of rows so that four projections of the two (2) rows at one end of said body will define an end square, the four (4) projections of the two rows that are spaced from the end projections of said body will define an intermediate square, and the four (4) projections of the two (2) rows at the other end of said body will define another end square, all of said squares being equally sized.

4. An interlocking building block as claimed in claim 3 wherein each of said pair of spaced passages is located within a different one of the end squares defined by said projections.

5. An interlocking building block as claimed in claim 1 wherein:

(a) said upper horizontal surface is defined by a spaced parallel pair of longitudinal side edges and a spaced pair of parallel transverse end edges;

(b) said projections are arranged in two spaced longitudinally extending rows with each row having four (4) of said projections equidistantly spacedly arranged therein, the four (4) projections in one row being transversely aligned with the four (4) projections in the other row with the space between each adjacent pair of longitudinally aligned projections being equal to the space between said pair of rows; and (c) each longitudinal row of projections being equally spaced inwardly from their respectively adjacent one of said side edges and the end projections of the rows being equally spaced inwardly from their respectively adjacent ones of said end edges.

6. An interlocking building block as claimed in claim 1 wherein each of said eight (8) projections are of equally sized frusto-conical configuration.

7. An interlocking building block as claimed in claim 1 wherein each of said eight (8) recesses are equally sized with respect to each other and with respect to said projections, each of said recesses configured to form one-half of a downwardly and laterally inwardly opening frustro-conical cavity.

8. An interlocking building block as claimed in claim 1 wherein each of said vertical columnar formations is sized on its upwardly disposed end to be approximately two (2) times the size of its downwardly disposed end.

9. An interlocking building block as claimed in claim 1 wherein:

(a) the one of said projections supported on said shelf-like portion is of frustro-conical configuration; and (b) the one of said recesses formed in said reduced mass portion is in the form of one-half of a frustro-conical cavity which opens downwardly and laterally into the adjacent one of said pair of passages.

10. An interlocking building block comprising:

(a) a cementitious body of rectangular solid configuration having an upper horizontal surface and a lower horizontal surface;

(b) six (6) projections integrally formed to extend normally from the upper horizontal surface of said body, said projections arranged on the upper surface in a predetermined geometric array;

(c) six (6) recesses formed in the lower surface of said body and configured to be complemental to said projections, said recesses arranged on the lower surface in the same geometric array as said projections are arranged on the upper surface of said body;

(d) a first passage formed through said body so as to extend between the upper and lower surfaces thereof, said passage formed in a cross-like shape in horizontal cross section to provide said body with four (4) vertically disposed cementitious columnar formations for supporting four (4) of said projections and in which four (4) of said recesses are formed;

(e) a second passage formed through said body so as to extend between the upper and lower surfaces and having one open side to provide said body with one open end, said second passage configured in horizontal cross section to have a longitudinally extending open portion and an opposed pair of transverse open portions to provide said body with two additional vertically disposed cementitious columnar formations for supporting the other two (2) of said projections and in which the other two (2) of said recesses are formed; and (f) each of said vertical columnar formations comprising, I. a shelf-like portion on the upwardly disposed end for supporting one of said projections, II. a reduced mass portion on the downwardly disposed end in which one of said recesses is formed, and III. a transition portion depending angularly from said shelf-like portion and merging with said reduced mass portion.

11. An interlocking building block as claimed in claim 10 wherein:

(a) said upper surface is defined by a spaced parallel pair of longitudinal side edges, a transverse end edge and an interrupted transverse end edge;

(b) said projections are arranged in two (2) spaced longitudinally extending rows with each row having three (3) of said projections equidistantly spacedly arranged therein, the three (3) projections in one row being transversely aligned with the three (3) projections in the other row with the space between each adjacent pair of longitudinally aligned projections being equal to the space between said pair of rows; and (c) each longitudinal row of projections being equally spaced inwardly from their respectively adjacent one of the side edges with two (2) transversely aligned end projections being spaced from the transverse end edge an amount equal to the space between the other two transversely aligned end projections and the interrupted transverse end edge.

12. An interlocking building block as claimed in claim 10 wherein:

(a) each of said six (6) projections are of equally sized frustro-conical configuration; and (b) each of said six (6) recesses are equally sized with respect to each other and with respect to said projections, each of said recesses configured to form one-half of a downward and laterally inwardly opening frustro-conical cavity.

13. An interlocking building block as claimed in claim 10 wherein:

(a) the one of said projections supported on said shelf-like portion is of frustro-conical configuration; and (b) the one of said recesses formed in said reduced mass portion is in the form of one-half of a frustro-conical cavity which opens downwardly and laterally into the adjacent one of said pair of passages.

14. An interlocking building block comprising:

(a) a cementitious body having an upper horizontal surface, a lower horizontal surface, a pair of opposed vertical face surfaces, and an opposed pair of vertical end surfaces;

(b) two (2) projections integrally formed to extend normally from the upper horizontal surface of said body, said projections arranged in a predetermined geometric array on said upper surface;

(c) two (2) recesses formed in the lower surface of said body and configured to be complemental to said projections, said recesses arranged on the lower surface in the same geometric array as said projections are arranged on the upper surface of said body; and (d) a passage formed through said body so as to extend between the upper and lower surfaces and having one open side extending to one of the vertical end surfaces of said body, said passage configured in horizontal cross section to have one open portion extending toward the closed one of the vertical end surfaces of said body and to have an opposed pair of open portions extending towards the opposed pair of vertical face surfaces to provide said body with a pair of vertically disposed cementitious columnar formations for supporting said projections and in which said recesses are formed, each of said vertical columnar formations comprising, I. a shelf-like portion on the upwardly disposed end for supporting one of said projections, II. a reduced mass portion on the downwardly disposed end in which one of said recesses is formed, and III. a transition portion depending angularly from said shelf-like portion and merging with said reduced mass portion.

15. An interlocking building block as claimed in claim 14 wherein:

(a) said upper horizontal surface is defined by a spaced pair of opposed side edges, an end edge and an opposed interrupted end edge; and (b) said projections spacedly aligned with each other normally with respect to said opposed pair of side edges and equally spaced from said end edge and from said interrupted end edge, each of said projections equally spaced from their respective adjacent ones of said opposed side edges.

16. An interlocking building block as claimed in claim 14 wherein:

(a) each of said projections are of equally sized frustoconical configuration; and (b) each of said recesses are equally sized with respect to each other and with respect to said projections, each of said recesses configured to form one-half of a downwardly and laterally opening frustro-conical cavity.

17. An interlocking building block as claimed in claim 14 wherein:

(a) the one of said projections supported on said shelf-like portion is of frustro-conical configuration; and (b) the one of said recesses formed in said reduced mass portion is in the form of one-half of a frustro-conical cavity which opens downwardly and laterally into said passage.

18. An interlocking building block comprising:

(a) a cementitious body having an upper horizontal surface, a lower horizontal surface, an opposed pair of vertical face surfaces and an opposed pair of vertical end surfaces;

(b) four (4) projections integrally formed to extend normally from the upper horizontal surface of said body, said projections arranged in a predetermined geometric array on said upper surface;

(c) four (4) recesses formed in the lower surface of said body and configured to be complemental to said projections, said recesses arranged on the lower surface in the same geometric array as said projections are arranged on the upper surface of said body; and (d) a passage formed through said body so as to extend between the upper and lower surfaces thereof, said passage formed in a cross-like horizontal cross sectional shape to provide said body with four (4) vertically disposed cementitious columnar formations for supporting said projections and in which said recesses are formed, each of said vertical columnar formations comprising, I. a shelf-like portion on the upwardly disposed end for supporting one of said projections, II. a reduced mass portion on the downwardly disposed end in which one of said recesses is formed, and III. a transition portion depending angularly from said shelf-like portion and merging with said reduced mass portion.

19. An interlocking building block as claimed in claim 18 wherein;

said projections define and locate the four (4) corners of a square which is centrally located on the upper horizontal surface of said body.

20. An interlocking building block as claimed in claim 19 wherein:

(a) each of said projections are of equally sized frustro-conical configuration; and (b) each of said recesses are equally sized with respect to each other and with respect to said projections, each of said recesses configured to form one-half of a downwardly and laterally opening frustro-conical cavity.

21. An interlocking building block as claimed in claim 18 wherein:

(a) the one of said projections supported on said shelf-like portion is of frustro-conical configuration; and (b) the one of said recesses formed in said reduced mass portion is in the form of one-half of a frustro-conical cavity which opens downwardly and laterally into said passage.

* * * * *